United States Patent [19]

Bernauer et al.

[11] 4,254,064

[45] Mar. 3, 1981

[54] CARBURETOR STARTING MIXTURE CONTROL

[75] Inventors: Lawrence J. Bernauer, Kohler; Roger T. Gault, Wild Rose, both of Wis.

[73] Assignee: Kohler Co., Kohler, Wis.

[21] Appl. No.: 62,974

[22] Filed: Aug. 2, 1979

[51] Int. Cl.[3] ..... F02M 5/08

[52] U.S. Cl. ..... 261/64 E; 261/72 R; 261/DIG. 67

[58] Field of Search ..... 261/DIG. 67, 64 E, 72 R

[56] References Cited

U.S. PATENT DOCUMENTS

| | | | |
|---|---|---|---|
| 1,605,280 | 11/1926 | Rayfield | 261/64 E |
| 1,817,860 | 8/1931 | Wahnish | 261/72 R |
| 1,919,793 | 7/1933 | Linga . | |
| 2,035,681 | 3/1936 | Udale . | |
| 2,134,877 | 11/1938 | Jedrzykowski . | |
| 2,701,709 | 2/1955 | Brunner . | |
| 2,796,243 | 6/1957 | McDuffie . | |
| 2,894,734 | 7/1959 | Wentworth | 261/DIG. 67 |
| 2,957,683 | 10/1960 | Eberhardt | 261/DIG. 67 |
| 3,001,774 | 9/1961 | Sarto | 261/72 R |
| 3,290,023 | 12/1966 | Sarto | 261/72 R |
| 3,346,245 | 10/1967 | Mennesson | 261/39 D |
| 3,408,054 | 10/1968 | Walker . | |
| 3,823,700 | 7/1974 | Gumtow | 261/64 E |
| 3,825,238 | 7/1974 | Nishihara et al. | 261/72 R |
| 3,837,322 | 9/1974 | Shishido et al. | 261/64 E |
| 3,940,460 | 2/1976 | Graybill . | |
| 4,040,399 | 8/1977 | Meininger | 261/72 R |
| 4,111,176 | 9/1978 | Fenton et al. | 261/DIG. 67 |

*Primary Examiner*—Tim R. Miles

*Attorney, Agent, or Firm*—Quarles & Brady

[57] ABSTRACT

A starting mixture control for a carburetor that controls the richness of the fuel mixture being fed to an associated engine after initial starting, the carburetor having a throat for supplying air to the engine that is equipped with a choke valve upstream from a venturi constriction, a throttle valve downstream from the venturi constriction, a fuel bowl with a fuel nozzle opening into the throat at the venturi constriction, a bowl vent passage for providing atmospheric pressure to the fuel bowl during normal engine operation, and a pressure transmitting by-pass duct communicating between the bowl vent passage and the carburetor throat. When the engine is cranked with the choke closed a rich fuel mixture is delivered to the engine, and when the engine starts the duct transmits the low pressure on the downstream side of the choke valve to the fuel bowl to reduce the flow of fuel from the fuel nozzle to lean out the fuel mixture delivered to the engine to prevent stalling until the choke valve is adjusted to an open position.

1 Claim, 5 Drawing Figures

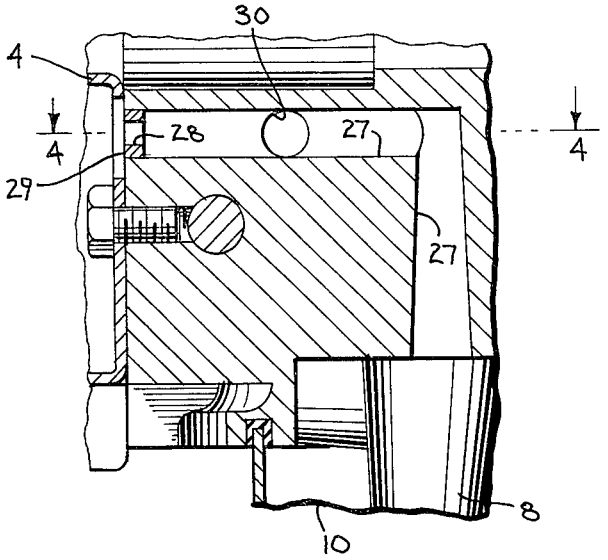
Fig. 3
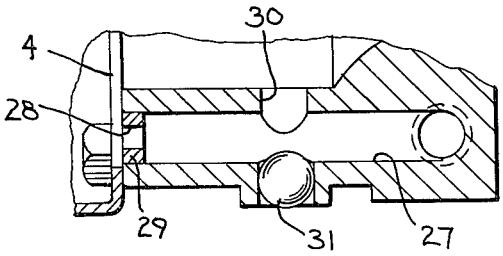
Fig. 4
Fig. 5
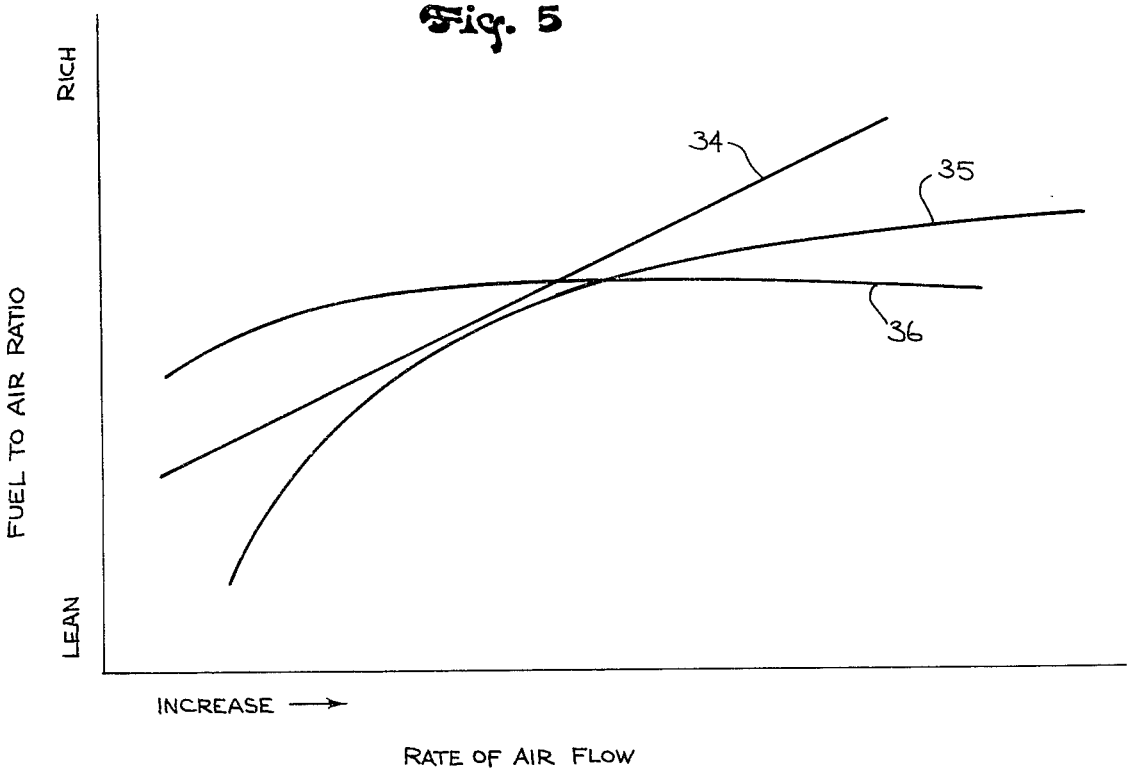

CARBURETOR STARTING MIXTURE CONTROL

BACKGROUND OF THE INVENTION (a) Field of the Invention

This invention relates to carburetors and a control for governing the richness of the fuel mixture being fed to an associated engine upon start-up. More particularly, it resides in an arrangement of air passages within a carburetor that reduce the pressure drop between the fuel bowl and the carburetor throat to lean out the fuel mixture immediately after initial starting to prevent the engine from stalling, and it has particular application to relatively simple carburetors for small gasoline engines in which the carburetor choke and throttle valves are manually adjusted.

(b) Description of the Art

Conventional carburetors are characterized by a choke valve located in the carburetor throat on the upstream side of a venturi constriction and a throttle valve on the downstream side of the venturi. When a cold engine is to be started the choke valve is closed to develop a pressure drop between the fuel bowl and the venturi constriction in response to engine suction. The relatively high pressure in the fuel bowl causes a substantial fuel flow to the carburetor venturi to develop a rich fuel-to-air mixture enabling the engine to fire. For quick starting the choke valve should be tight, or "severe", with a minimum of air leakage through or around its air blocking surface in order to obtain a relatively high pressure drop between the fuel bowl and the venturi. However, once the engine commences running the pressure in the carburetor throat tends to drop due to greater engine demand, and with a tight choke a greater pressure differential then develops between the fuel bowl and venturi. This increased pressure differential may cause the fuel to air mixture to become too rich with a consequent stalling of the engine.

In order to reduce the richness of the fuel mixture after initial starting, some choke valves have been equipped with mechanical spring loaded relief valves mounted on their surfaces which automatically open in response to increased engine air demand, thus allowing air flow through the choke valve even though it is in closed position. The increased air flow is to satisfy engine demand and also reduce the richness of the fuel-air mixture. Such designs have not been entirely satisfactory because they have an inherent problem of spring rate sensitivity, and are subject to sticking due to corrosion, accumulations of foreign matter and ice build-up in cold weather.

Another approach to leaning out the fuel mixture has been to employ small relief holes in the surface of the choke valve, or to provide small bleeder holes around the valve. Such designs have limitations in that they are a compromise between the best configurations for cranking and initial running. Also, during very cold weather, approximately 0° F. or below, a carburetor with relief holes for the choke valve must have the throttle valve set in a near idle, or closed, position to create a lower pressure on the throttle valve downstream side to sufficiently vaporize the fuel for starting. However, in very cold weather it is desirable to set the throttle valve in a more open position, such as fast idle or wide open to deliver a greater amount of vaporized fuel for combustion. Sufficient vaporized fuel needed during cold weather may not be developed with an open throttle valve unless a very severe choke valve is used. However, if a severe choke is used, a fuel mixture too rich for combustion may result after initial engine start. The present invention has been developed to answer the problem of controlling engine fuel mixtures during cranking and initial firing, and for continued operation until the choke valve is adjusted.

SUMMARY OF THE INVENTION

The invention herein resides in a carburetor for an engine having both a bowl vent passage that admits atmospheric pressure to the carburetor fuel bowl, and a pressure transmitting duct between the fuel bowl and the side of the carburetor throat that is downstream of a choke valve for promptly reducing the pressure in the fuel bowl when the engine commences to fire and turn over.

The arrangement provides a starting mixture control which decreases the richness of the fuel mixture delivered to the engine after initial starting to prevent the engine from stalling. More specifically, the invention decreases the pressure difference between the carburetor venturi and the fuel bowl when the engine starts to decrease the amount of fuel being discharged into the throat. For starting, the choke valve is closed, and when the engine is cranked the engine suction reduces the pressure in the carburetor throat. Atmospheric pressure in the fuel bowl then causes fuel to be delivered through its associated feed nozzle to a venturi constriction in the throat. As the engine begins running, the suction of the cylinders causes a lower pressure in the carburetor throat on the downstream side of the closed choke valve. This lower pressure is transmitted to the fuel bowl through the pressure transmitting duct. The pressure difference between the fuel bowl and the fuel nozzle in the throat is thereby decreased, causing less fuel to pass through the nozzle. This process makes the fuel mixture leaner than it would otherwise be after initial firing, and prevents the engine from stalling. The engine will then continue to run at a slow speed until the choke valve is opened to some optimum position. During this period of operation, the bowl vent passage and pressure transmitting duct will supply air to the carburetor and engine for continued slow speed operation.

The invention is particularly adapted for simpler forms of carburetors used with small gasoline engines that power lawn mowers, snow blowers, snowmobiles, garden tractors, chain-saws, stand-by power plants and the like. They are characterized by manually adjustable chokes, rather than complex arrangements such as manifold pressure responsive bellows and thermostats working in tandem for automatic control of a choke valve. This class of carburetor has unique problems for starting. It is desirable, for example, to have a severely closed choke position for initial engine cranking to reduce the pressure in the carburetor to obtain fuel vaporization and a rich mixture, and also to have an open throttle that enables the feeding of adequate air and fuel to the engine to permit continued operation upon initial firing. The carburetor must also sustain initial engine operation with the choke and throttle in these positions until some manual adjustment is made. The present invention is directed to this problem of simpler forms of carburetors.

The invention is also useful for governor controlled engines having a governor that moves the carburetor throttle to open position when the engine is at standstill. Upon starting the strong suction from the engine which reduces the pressure at the venturi will not cause excessive fuel flow because the fuel bowl pressure is reduced to limit fuel flow into the carburetor throat. The engine can then run at some slow speed until the operator opens the choke, at which time the engine can come up to governor speed with an accompanying closing of the throttle to the setting dictated by the governor.

It is an object of the invention to provide an improved starting mixture control for a carburetor which controls the mixture strength being fed to an engine after initial start-up, to thereby prevent the engine from stalling.

It is another object of the invention to provide a control over the starting mixture which eliminates mechanical relief valves, or openings in or around the choke valve that are a compromise from a severe choke.

Another object of the invention is to provide a fuel mixture control system with a severe choke that will have sufficient fuel vaporization to permit engine start-up in cold weather at fast idle or wide open throttle settings.

Another object of the invention is to provide an improved starting mixture control which is highly effective, but is also relatively inexpensive and easy to manufacture, assemble and maintain.

Still further objects of the invention are to reduce the sensitivity of the setting of the idle speed stop screw, and to permit the throttle to be controlled by a governor that places the throttle in open position when at standstill.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, but rather the invention may be employed in other embodiments, and reference is made to the claims herein for interpreting the breadth of the invention.

BRIEF DESCRIPTION OF THE DRAWINGS

FIG. 3 is a fragmentary view in section of the carburetor taken in the plane 3—3 indicated in FIG. 2, FIG. 4 is a fragmentary view in section of the carburetor taken in the plane 4—4 indicated in FIG. 3, and FIG. 5 is a graph illustrating the results of the invention.

DESCRIPTION OF THE PREFERRED EMBODIMENT

Figure 1:
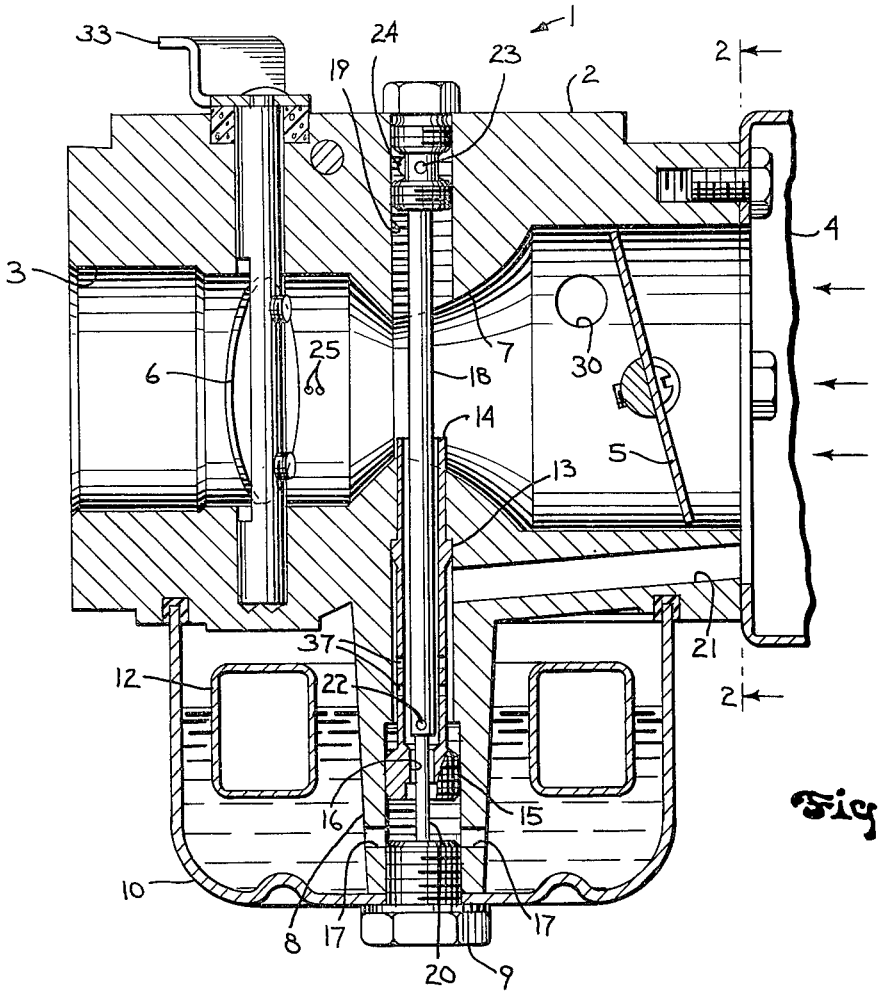
FIG. 1 is a side view in section of a carburetor embodying the invention.

Referring to FIG. 1, there is shown a carburetor 1 having a body 2 with the usual throat 3 that delivers air and fuel to the intake of an engine. An air cleaner 4, which is only partially shown, is mounted at the inlet, or upstream end of the throat 3 to filter air drawn into the carburetor 1. The upstream end of the throat 3 houses the vane of a manually operable, butterfly type choke valve 5, and the outlet, or downstream portion of the throat 3 houses the vane of a manually operable, butterfly type throttle valve 6. The outlet end of the throat 3 leads to the intake manifold (not shown) of an associated gasoline engine. A conventional venturi constriction 7 in the throat 3 is located amid-ship the carburetor body 2 between the downstream side of the choke valve 5 and the upstream side of the throttle valve 6.

Affixed to the bottom of the body 2 is a depending, frusto-conical, hollow column 8. Secured to the bottom of the column 8 by a bolt 9 is a fuel bowl 10 for holding a supply of fuel that enters from a fuel inlet line 11. Contained within the fuel bowl 10 is an annular shaped float 12 that is part of a conventional flow control assembly (not shown) which governs fuel flow from the line 11 and maintains a desired fuel level within the bowl 10. Within the hollow column 8 is a tubular fuel nozzle 13 which extends upwardly into the venturi constriction 7. The upper end 14 of the fuel nozzle 13 opens into the venturi 7 so as to discharge fuel into the carburetor throat 3 in usual fashion.

As seen in FIG. 1, the lower end 15 of the fuel nozzle 13 is in threaded engagement with the interior opening of the column 8 and presents a restricted fuel metering opening 16 through which a controlled amount of fuel flows from fuel inlet ports 17 in the bottom end of the column 8. Inside the nozzle 13 is a hollow fixed metering and idle rod 18 that is threaded into an opening 19 in the upper part of the carburetor body 2. The lower end 20 of the rod 18 passes through the metering opening 16 to regulate fuel flow to the venturi 7. This lower end 20 is cylindrical to function as a fixed metering rod, but if desired a tapered needle control can be used in which the rod 18 is longitudinally movable to permit adjustment of fuel flow. These alternatives, and the form of the rod 18 and fuel nozzle 13 are known in the art.

Figure 2:
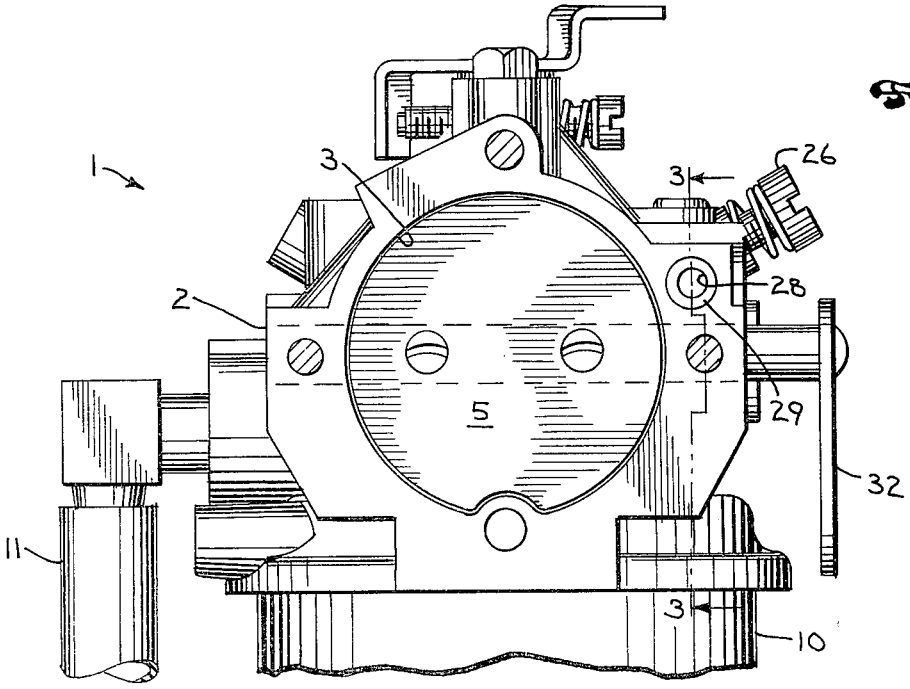
FIG. 2 is an end view of the carburetor of FIG. 1 with the air cleaner removed as seen from the air intake end.

An air bleed passage 21 conducts air into the hollow column 8 that passes through openings 37 in the nozzle 13 for mixing, in known manner, with the gas moving up the nozzle 13. For supplying gas during engine idle operation, when there is insufficient pressure drop in the venturi 7 to cause fuel flow to the nozzle opening 14, the hollow metering rod 18 has an opening 22 at its lower end to receive gas that passes upwardly through the rod 18. This gas exits from the opening 23 in the top of the rod 18 to flow into a duct 24 that leads to idle fuel openings 25 alongside the edge of the throttle valve 6. The duct 24 includes a fuel metering orifice having an adjustment screw 26 shown in FIG. 2. This idle fuel arrangement is also in conformance with prior carburetor constructions.

As seen in FIGS. 3 and 4, a bowl vent passage 27 is formed in the carburetor body 2 which includes a horizontal run having a sized inlet opening 28 formed in a bushing 29. The bushing 29 is set in the end of the passage 27 that receives air through the air cleaner 4 at substantially atmospheric pressure. The other end of the bowl vent passage 27 turns downwardly and leads to the interior of the fuel bowl 10, so that the fuel bowl interior will be at atmospheric pressure before the engine is started, and also near this value during normal engine operation. Bowl vent passages of this type are commonly employed.

A short by-pass duct 30 opens upon the carburetor throat 3, as seen in FIGS. 1, 3 and 4, on the downstream side of the choke valve 5 at a point between the choke valve 5 and the venturi constriction 7. The duct 30 was formed by drilling and a spherical plug 31 closes one end of the drilled hole. This duct 30 branches off of the bowl vent passage 27, and therefore communicates with both the interior of the fuel bowl 10 and with the atmosphere. The duct 30 allows air movement between the bowl 10 and the throat 3 in response to pressure differentials, and may therefore be conveniently termed a pressure transmitting duct. The duct 30 in combination with the horizontal portion of the passage 27 and its bushing 29 also forms a restricted by-pass around the choke 5.

When the carburetor 1 is operating under normal running conditions, the choke valve 5 is open and air is drawn through the air cleaner 4 into the right hand end of the throat 3 (as seen in FIG. 1), to flow through the venturi constriction 7 and past the throttle valve 6 to the engine manifold. A pressure drop develops in the venturi constriction 7, and the difference between the pressure of the air in the fuel bowl 10 and that in the venturi 7 causes fuel to be discharged through the fuel nozzle 13 into the venturi 7. Fuel vaporization takes place, and the resulting mixture is fed to the engine. Under these normal conditions the bowl vent passage 27 maintains the fuel bowl 10 at or near atmospheric pressure.

For starting the engine, the mixture control provided by the bowl vent passage 27 and duct 30 comes into play. For a cold engine, the operator sets the choke valve 5 closed by operating a choke control connected to the choke lever 32, and the throttle valve 6 is set preferably in at least partially open position. This setting of the throttle could be a direct manual control connected to the throttle lever 33, or through a governor that sets the throttle open when the engine is at standstill. Before turning the engine over, the fuel bowl 10 is at atmospheric pressure, due to its communication with the atmosphere through the bowl vent passage 27. As the engine is now cranked, its suction develops a low pressure in the carburetor throat 3, since the closed choke valve 5 restricts air flow into the carburetor. The resulting difference between the air pressure in the fuel bowl 10 and that in the venturi constriction 7 causes fuel to be discharged through the fuel nozzle 13 into the venturi 7. The fuel then vaporizes and mixes with the available air, and is carried into the engine and ignited to commence engine operation. At this stage, the fuel-to-air mixture will be rich, to enable the engine to fire quickly.

As the engine starts to run its air demand increases, but the closed choke valve 5 acts to restrict air flow to the engine. In the absence of the pressure transmitting duct 30, the fuel-to-air mixture may now become too rich for continued engine operation, for the increased engine air demand further reduces the pressure in the venturi 7, and the pressure differential with respect to the fuel bowl interior can increase to deliver more fuel than desired. The invention provides a means to control the fuel mixture, and the duct 30 functions for this purpose. It presents an air path between the fuel bowl 10, which is at a higher pressure, and the carburetor throat 3, which is at a lower pressure. The pressure differential between the bowl 10 and throat 3 is then sensed through the duct 30 and part of the passage 27, and consequent air movement from the bowl 10 toward the throat 3 reduces fuel bowl pressure as engine speed increases. This in turn decreases the amount of fuel delivered through the nozzle 13. The communication between the fuel bowl and carburetor throat is sufficient to reduce bowl pressure, and at the same time adequate air for sustaining engine operation at a slow speed will flow from the air cleaner 4 through the opening 28, the passage 27 and the duct 30 into the carburetor throat 3. This air flow from the air cleaner through the passage 27 is limited, so as not to interfere with the pressure drop that occurs within the bowl 10. The air path between the bowl 10 and the carburetor throat 3 can be considered as in parallel to the flow of engine air from the cleaner 4 for this phase of initial engine operation.

The hole sizes of the fuel bowl vent passage 27, the opening 28 and the pressure transmitting duct 30 are to be proportioned to obtain the desired air flow rates and pressure changes to control mixture. With a decreased fuel flow that now occurs upon initial engine start, the fuel-to-air mixture is controlled to continue engine operation at a low speed, until the operator adjusts the choke valve 5 to directly admit air from the cleaner 4 past the valve 5 into the carburetor throat 3. Upon opening the choke 5 substantial air enters directly through the throat 3, and the passage 27 becomes insignificant as an air supply for the engine. The passage 27 then performs its normal function of providing atmospheric pressure to the bowl 10.

The choke valve 5 may be made tight, or severe, when in closed position, to obtain good starting in cold weather. As has been noted, for cold weather starting, the throttle valve 6 may be set in an open position, and because of the severe choking the vacuum within the throat 3 and downstream of the throttle valve 6 will be low enough to obtain the necessary fuel vaporization. The throttle valve 6 will not have to be in a closed idle position, to obtain a vacuum on its downstream side for vaporization, as in some prior constructions that do not have a severe choke.

In a preferred embodiment for one particular engine that has successfully demonstrated the invention, the duct 30 had a diameter of about 0.228 inches, resulting in an area of about 0.04 square inches. The bowl vent passage 27 had a diameter of about 0.228 inches along its horizontal run, for an area of about 0.04 square inches, and the vertical run, as seen in FIG. 1, was tapered down to about 0.182 inches for an area of about 0.026 square inches. The diameter of the restriction presented by the opening 28 for the bowl vent passage 27 was about 0.108 inches, with an area of about 0.009 square inches. This resulted in a ratio of about 5 to 1 for the effective area of the duct 30 to that of the bowl vent passage 27 at the point of its smallest restriction, which is at the opening 28. Also, the pressure sensing channel comprising the duct 30 and the part of passage 27 entering from the duct 30 into the bowl was of a size to effect desired pressure changes in the bowl 10. The dimensions must be properly determined for the size and nature of the engine and carburetor being used, in order to establish a balance between cranking and initial running mixture requirements. The dimensions recited were for a carburetor having a throat diameter of 1 7/16 inches and a reduced diameter at the venturi constriction 7 of 15/16 inches. The proper area ratio not only ensures that enough air is bypassed around the choke valve 5 to support combustion, but it also maintains an adequate pressure drop between the bowl 10 and venturi 7 to deliver the correct amount of fuel. Although the ratio will vary with the carburetor and engine employed, it can be generally stated that the bowl vent passage 27 should have a restriction in cross section area less than that of the pressure transmitting duct 30 and its channel leading to the bowl 10. The transmission of pressure between the fuel bowl 10 and the carburetor throat 3 is not to be masked by engine air entering the restricted opening 28 of the passage 27.

FIG. 5 illustrates the improvement obtained by use of the invention. The ordinate of the graph represents the fuel-to-air ratio, and the abscissa the rate of air flow for the carburetor. All three curves 34, 35 and 36 are for operation at full choke, with curves 34 and 35 representing commercial prior art carburetors, and curve 36 a carburetor embodying the present invention. Curve 34 is a prior art carburetor having its throttle valve at low idle speed, i.e. near a closed position, and it is seen that the fuel-to-air mixture becomes increasingly rich with increasing air flow. Curve 35 is for a like prior art carburetor with the throttle valve wide open. Its fuel richness is decreased at the higher air flow rates compared with curve 34, which is advantageous, but at low air flow the mixture is very lean. Curve 36 is for a carburetor of the invention at wide open throttle. It has a more level fuel-to-air ratio that enhances engine starting, both for ordinary and cold weather conditions.

A primary purpose of the invention is to achieve quick starting of an engine. A choke having a solid vane without openings in its surface and which closely conforms around its perimeter with the carburetor throat when set in closed position is employed in order to develop a low pressure in the carburetor upon initial cranking. This produces a rich fuel mixture and atomizes the fuel. To make possible the use of such a tight choke an air path is provided between the fuel bowl and the carburetor throat to reduce air pressure in the bowl after starting. This leans out the fuel mixture from what it might otherwise be. The air path has negligible affect upon fuel bowl pressure during initial cranking, although under continuous prolonged cranking it might cause some reduction in pressure. With a quick start of the engine this does not occur, and the invention thus provides a control over the fuel mixture in starting an engine to improve starting. The control is simple in construction, inexpensive to manufacture and requires no maintenance. While a preferred embodiment has been described, it is apparent that the location and form of the bowl vent passage 27 and pressure transmitting duct 30 may vary. For example, the duct 30 might be separate from the passage 27, instead of joining with the passage 27 for a common entry into the fuel bowl, and reference is made to the following claims for an interpretation of the scope of the invention.

We claim:

1. In a carburetor for feeding fuel to an associated engine having a throat, a venturi constriction in said throat, a manually operable choke valve in said throat positioned upstream of said venturi, a throttle valve in said throat positioned downstream of said venturi, a fuel bowl with a fuel nozzle opening upon said venturi, and a bowl vent passage connecting said fuel bowl with the atmosphere, the combination comprising:

a duct opening upon said carburetor throat at a point downstream from said choke valve and permanently joining with said bowl vent passage to have communication (i) between said fuel bowl and the downstream side of said choke valve and (ii) between the end of said bowl vent passage venting to the atmosphere and the downstream side of said choke valve;

a tightly closed choke valve setting and a partially open throttle valve setting providing a rich fuel mixture for an associated engine upon an initial cranking to start the engine;

said duct acting upon an initial running of an associated engine and while the choke valve setting is closed (i) to transmit air pressure differences between the fuel bowl and carburetor throat to reduce richness of the fuel-air mixture, and (ii) to feed air from the atmosphere around said choke valve into said carburetor throat; and said bowl vent passage having a constricted air inlet communicating with the atmosphere that is of smaller constriction than the communication of said fuel bowl with said carburetor throat through said duct.

* * * * *